US009267687B2

(12) United States Patent
Khan et al.

(10) Patent No.: US 9,267,687 B2
(45) Date of Patent: Feb. 23, 2016

(54) COMBUSTION SYSTEM HAVING A VENTURI FOR REDUCING WAKES IN AN AIRFLOW

(75) Inventors: Abdul Rafey Khan, Greenville, SC (US); David William Cihlar, Greenville, SC (US); Ajay Pratap Singh, Karnataka (IN); Bradley Donald Crawley, Simpsonville, SC (US); Jason Thurman Stewart, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1020 days.

(21) Appl. No.: 13/289,537

(22) Filed: Nov. 4, 2011

(65) Prior Publication Data

US 2013/0111909 A1 May 9, 2013

(51) Int. Cl.
*F23R 3/54* (2006.01)
*F23R 3/00* (2006.01)

(52) U.S. Cl.
CPC . *F23R 3/002* (2013.01); *F23R 3/54* (2013.01); *F23R 2900/03044* (2013.01)

(58) Field of Classification Search
USPC ..... 60/752–760
See application file for complete search history.

(56) References Cited

U.S. PATENT DOCUMENTS

| | | | |
|---|---|---|---|
| 3,643,426 | A | 2/1972 | Janelid |
| 3,734,639 | A | 5/1973 | Short |
| 3,765,178 | A | 10/1973 | Hufnagel et al. |
| 3,800,530 | A | 4/1974 | Nash |
| 4,259,842 | A | 4/1981 | Koshoffer et al. |
| 4,786,016 | A | 11/1988 | Presz, Jr. et al. |
| 4,802,821 | A | 2/1989 | Krietmeier |
| 4,844,689 | A | 7/1989 | Seed |
| 4,896,510 | A | 1/1990 | Foltz |
| 4,968,216 | A | 11/1990 | Anderson et al. |
| 5,226,278 | A | 7/1993 | Meylan et al. |
| 5,274,991 | A | 1/1994 | Fitts |
| 5,406,786 | A | 4/1995 | Scharpf et al. |
| 5,486,091 | A | 1/1996 | Sharma |
| 5,749,218 | A | 5/1998 | Cromer et al. |
| 5,785,498 | A | 7/1998 | Quinn et al. |

(Continued)

FOREIGN PATENT DOCUMENTS

| | | | |
|---|---|---|---|
| CA | 2429413 | A1 | 5/2002 |
| CN | 1582365 | A | 2/2005 |

(Continued)

OTHER PUBLICATIONS

Search Report and Written Opinion from EP Application No. 12190923.8 dated Feb. 13, 2013.

(Continued)

*Primary Examiner* — Arun Goyal
(74) *Attorney, Agent, or Firm* — Dority & Manning, PA

(57) ABSTRACT

A combustion system is provided having a liner, a flow sleeve, a flow-obstructing element, and a venturi. The liner is disposed around a combustion region. The flow sleeve is disposed around the liner. The liner and the flow sleeve cooperate to create an air passage having an airflow located between the liner and the flow sleeve. The flow-obstructing element is disposed within the air passage, and generally obstructs the airflow in the air passage to create wakes in the airflow. The venturi is disposed downstream from the flow-obstructing element, and generally restricts and diffuses the airflow in the air passage to reduce wakes in the airflow.

15 Claims, 4 Drawing Sheets

(56) References Cited

U.S. PATENT DOCUMENTS

| | | | | |
|---|---|---|---|---|
| 5,813,828 | A | 9/1998 | Norris | |
| 6,174,129 | B1 | 1/2001 | Mazzola et al. | |
| 6,209,325 | B1 | 4/2001 | Alkabie | |
| 6,345,493 | B1 | 2/2002 | Smith et al. | |
| 6,402,458 | B1 | 6/2002 | Turner | |
| 6,409,126 | B1 | 6/2002 | Cunningham, Jr. | |
| 6,435,814 | B1 | 8/2002 | Yu et al. | |
| 6,438,961 | B2 | 8/2002 | Tuthill et al. | |
| 6,442,941 | B1 | 9/2002 | Anand et al. | |
| 6,446,438 | B1 * | 9/2002 | Kraft et al. | 60/737 |
| 6,484,505 | B1 | 11/2002 | Brown et al. | |
| 6,527,503 | B2 | 3/2003 | Spano et al. | |
| 6,543,234 | B2 | 4/2003 | Anand et al. | |
| 6,584,779 | B2 | 7/2003 | Priestley | |
| 6,598,398 | B2 | 7/2003 | Viteri et al. | |
| 6,602,458 | B1 | 8/2003 | Skov | |
| 6,626,635 | B1 | 9/2003 | Prowse | |
| 6,772,595 | B2 * | 8/2004 | Martling et al. | 60/737 |
| 6,824,710 | B2 | 11/2004 | Viteri et al. | |
| 6,899,081 | B2 | 5/2005 | Bielicki et al. | |
| 6,910,335 | B2 | 6/2005 | Viteri et al. | |
| 6,935,116 | B2 | 8/2005 | Stuttaford et al. | |
| 6,958,383 | B2 | 10/2005 | Desmazeau et al. | |
| D511,377 | S | 11/2005 | Erwan et al. | |
| 7,089,742 | B2 | 8/2006 | Spooner et al. | |
| 7,340,129 | B2 | 3/2008 | Yalin et al. | |
| 7,373,773 | B2 | 5/2008 | Noda | |
| 7,410,343 | B2 | 8/2008 | Wakazono et al. | |
| 7,412,129 | B2 | 8/2008 | Yalin et al. | |
| 7,420,662 | B2 | 9/2008 | Yalin et al. | |
| 7,574,865 | B2 | 8/2009 | Bland | |
| 7,654,320 | B2 | 2/2010 | Payton | |
| 7,762,074 | B2 | 7/2010 | Bland et al. | |
| 7,762,075 | B2 | 7/2010 | Pangle et al. | |
| 7,805,946 | B2 | 10/2010 | Ohri et al. | |
| 7,896,645 | B2 | 3/2011 | Loving | |
| 8,020,385 | B2 | 9/2011 | Popovic et al. | |
| 8,234,872 | B2 | 8/2012 | Berry et al. | |
| 8,307,657 | B2 | 11/2012 | Chila | |
| 8,308,112 | B2 | 11/2012 | Wood et al. | |
| 8,516,822 | B2 * | 8/2013 | Chen et al. | 60/752 |
| 8,707,672 | B2 | 4/2014 | Zuo et al. | |
| 2002/0048510 | A1 | 4/2002 | Spano et al. | |
| 2002/0124572 | A1 | 9/2002 | Pidcock et al. | |
| 2003/0136102 | A1 | 7/2003 | Nottin | |
| 2005/0172607 | A1 | 8/2005 | Ishizaka et al. | |
| 2005/0206196 | A1 | 9/2005 | Ortega et al. | |
| 2006/0101801 | A1 | 5/2006 | Bland | |
| 2006/0283189 | A1 | 12/2006 | Lipinski et al. | |
| 2007/0130958 | A1 | 6/2007 | Ohri et al. | |
| 2007/0251240 | A1 * | 11/2007 | Johnson et al. | 60/796 |
| 2009/0019854 | A1 | 1/2009 | Simons et al. | |
| 2009/0155062 | A1 | 6/2009 | Guimbard et al. | |
| 2009/0223228 | A1 | 9/2009 | Romoser | |
| 2009/0320484 | A1 * | 12/2009 | Lacy et al. | 60/748 |
| 2010/0054929 | A1 | 3/2010 | Ning et al. | |
| 2010/0111684 | A1 | 5/2010 | Ning et al. | |
| 2010/0122538 | A1 | 5/2010 | Ning et al. | |
| 2010/0287943 | A1 | 11/2010 | McMahan et al. | |
| 2011/0107766 | A1 | 5/2011 | Davis, Jr. et al. | |
| 2011/0197586 | A1 | 8/2011 | Berry et al. | |
| 2011/0214428 | A1 | 9/2011 | Shershnyov et al. | |
| 2012/0085100 | A1 | 4/2012 | Hughes et al. | |
| 2012/0159954 | A1 * | 6/2012 | Ito et al. | 60/752 |
| 2012/0167586 | A1 | 7/2012 | Bailey et al. | |
| 2012/0186255 | A1 | 7/2012 | Parsania et al. | |
| 2012/0247118 | A1 | 10/2012 | Antoniono et al. | |
| 2012/0297785 | A1 | 11/2012 | Melton et al. | |
| 2013/0115566 | A1 | 5/2013 | Khan et al. | |
| 2014/0041357 | A1 | 2/2014 | Malandra et al. | |

FOREIGN PATENT DOCUMENTS

| | | | |
|---|---|---|---|
| CN | 101050722 | A | 10/2007 |
| CN | 101173673 | A | 5/2008 |
| CN | 101349425 | A | 1/2009 |
| CN | 101639220 | A | 2/2010 |
| CN | 102192510 | A | 9/2011 |
| EP | 1130321 | A1 | 9/2001 |
| EP | 1482246 | A1 | 12/2004 |
| EP | 2154431 | A2 | 2/2010 |
| JP | 54114619 | A | 9/1979 |

OTHER PUBLICATIONS

Extended European Search Report for EP Application No. 12190915.4-1602, dated Feb. 11, 2013, pp. 1-8.

English Translation of Chinese Office Action for CN Application No. 201210369382.6, dated Feb. 25, 2015, pp. 1-11.

Unofficial English Translation of Chinese Office Action issued in connection with corresponding CN Application No. 201210432435.4 on Aug. 5, 2015.

* cited by examiner

COMBUSTION SYSTEM HAVING A VENTURI FOR REDUCING WAKES IN AN AIRFLOW

BACKGROUND OF THE INVENTION

The subject matter disclosed herein relates to a combustion system, and more specifically to a combustion system with an air passage defined by a liner and a flow sleeve, and a venturi generally restricting and diffusing airflow in the air passage.

Gas turbines include a compressor that supplies compressed air to a combustor. Specifically, compressed air is supplied through a gap or space between a liner and a flow sleeve of the combustor. There are typically different types of structures that may be disposed within the space between the liner and the flow sleeve such as, for example, a crossfire tube or a flame detector. Flow disturbances, which are typically referred to as wakes, may be created as the compressed air flows past these structures.

A wake is a zone of aerodynamic disturbance created by a component such as a crossfire tube, and represents a region of re-circulating flow located downstream of the structure. The presence of wakes in the space between the liner and the flow sleeve may create several issues. For example, fuel injected downstream of the structure may be pulled into the wake. Fuel may accumulate in the wake and cause flame holding, which in turn decreases gas turbine performance. Wakes may also cause hardware issues in the gas turbine, which may potentially cause the gas turbine to shut down. Wakes may also create a higher pressure drop across the liner. In an effort to improve features such as gas turbine flame holding performance, a relatively wake free flow field is provided.

BRIEF DESCRIPTION OF THE INVENTION

According to one aspect of the invention, a combustion system is provided having a liner, a flow sleeve, a flow-obstructing element and a venturi. The liner is disposed around a combustion region. The flow sleeve is disposed around the liner. The liner and the flow sleeve cooperate to create an air passage having an airflow located between the liner and the flow sleeve. The flow-obstructing element is disposed within the air passage, and generally obstructs the airflow in the air passage to create wakes in the airflow. The venturi is disposed downstream from the flow-obstructing element, and generally restricts and diffuses the airflow in the air passage to generally reduce wakes in the airflow.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
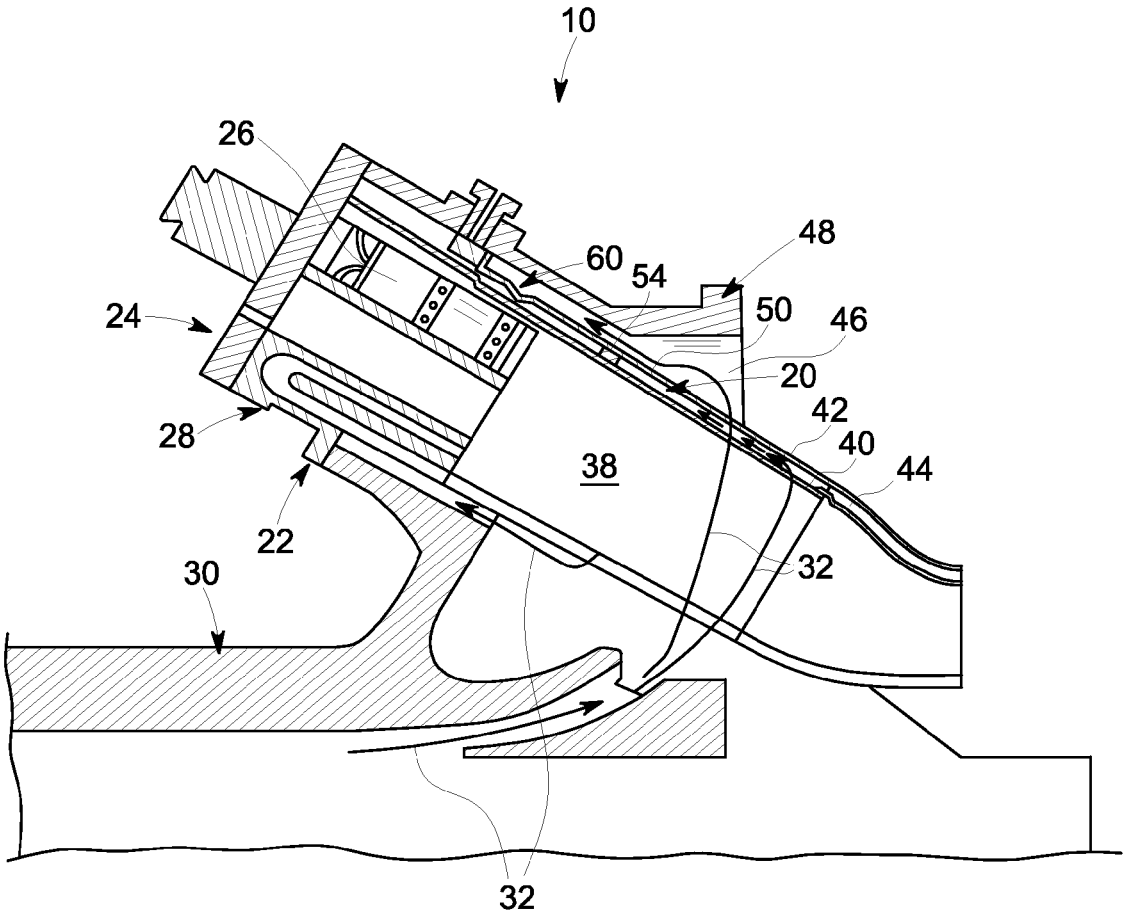
FIG. 1 is a cross-sectional side view of a combustion system with features according to the teachings herein.

FIG. 1 is an exemplary illustration of a combustion system 10 having a combustor body 20, a quaternary cap 22, an end cover 24, and at least one fuel nozzle 26. The fuel nozzle 26 is attached to the end cover 24, at a head end 28 of the combustion system 10. Air is compressed by a compressor 30 into a stream of compressor discharge air 32, which is provided to the combustion system 10. The compressor discharge air 32 is then mixed with fuel supplied by the fuel nozzle 26 of the combustion system 10. The combustor body 20 includes a combustion region 38 that is defined by a liner 40. The combustion system 10 also includes a flow sleeve 42 that is disposed around the liner 40. In one exemplary embodiment, the combustion system 10 is employed in a gas turbine system (not shown).

In the embodiment as shown, the liner 40 and the flow sleeve 42 cooperate together and create an air passage 44. The air passage 44 is created in the gap or space between the liner 40 and the flow sleeve 42. The air passage 44 has an airflow located between the liner 40 and the flow sleeve 42. Specifically, a portion of the compressor discharge air 32 is provided to the air passage 44. The compressor discharge air 32 flows in the air passage 44 to the fuel nozzle 26, which distributes an air-fuel mixture into the combustion region 38. The compressor discharge air 32 located in the air passage 44 may be used for cooling and for entry into the head end 28. The compressor discharge air 32 is also provided to a second air passage 46 that is defined by a combustor housing 48 and a casing wall or outer surface 50 of the flow sleeve 42. Both the air passage 44 and the second air passage 46 deliver the compressor discharge air 32 to the quaternary cap 22.

Figure 2:
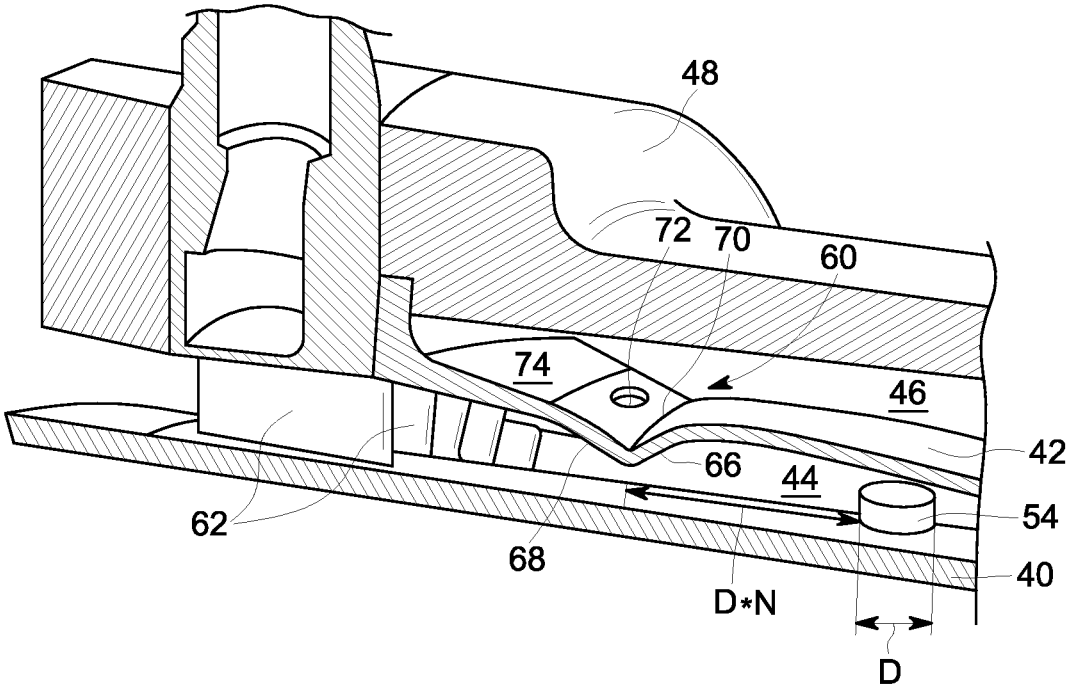
FIG. 2 is a side perspective view of an airflow passage of the combustion system shown in FIG. 1 having a venturi and at least one air aperture therethrough.

Referring to both FIGS. 1-2, a flow-obstructing element 54 is disposed within the air passage 44. The flow-obstructing element 54 is typically any device that generally obstructs the airflow in the air passage 44. Specifically, the flow-obstructing element 54 obstructs the airflow to create a wake (not shown). The wake is typically a region of re-circulating flow downstream of the flow-obstructing element 54. The flow-obstructing element 54 may be any type of device usually found in the air passage 44 of a gas turbine, such as, for example, a cross-fire tube, a flame detector, a spark plug, a liner stop, a boss, a pressure probe, or a sensor.

A venturi 60 is disposed downstream from the flow-obstructing element 54 and is defined as a portion of the flow sleeve 42. Referring now to FIG. 2, the venturi 60 is employed to generally restrict airflow in the air passage 44 and diffuse the airflow to a set of quaternary vanes 62 without a significant amount of airflow separation. That is, the venturi 60 is employed to substantially reduce the wakes created by the flow-obstructing element 54 before the airflow reaches the quaternary vanes 62. Specifically, the venturi 60 has a converging section 66 and a diverging section 68. The converging section 66 is employed to restrict the airflow in the air passage 44, and the diverging section is employed to diffuse the airflow to the quaternary vanes 62.

Figure 4:
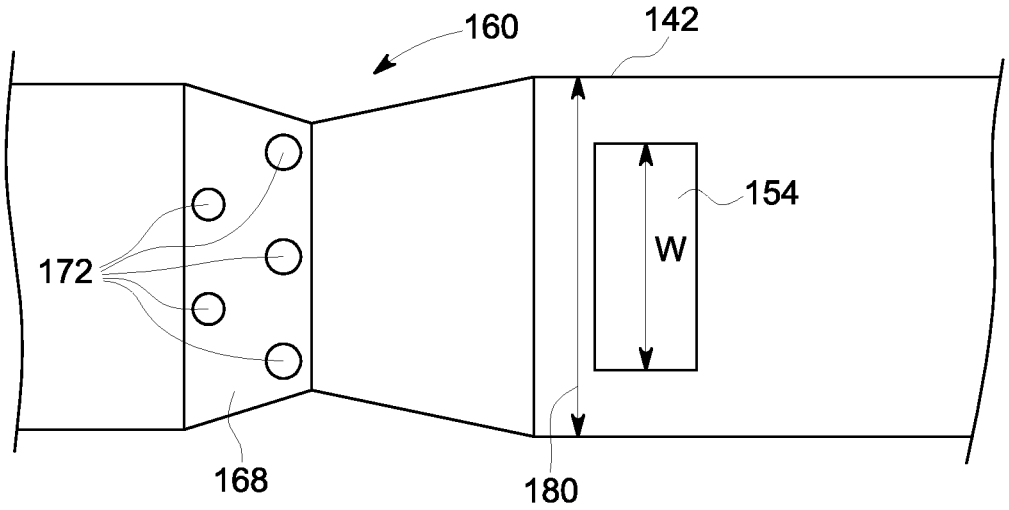
FIG. 4 is a schematic overhead view of an alternative embodiment of the air aperture shown in FIG. 2.

The venturi 60 also has a throat 70, which connects the converging section 66 with the diverging section 68. In one embodiment, the throat 70 provides a reduction in the cross-sectional area of the air passage 44 ranging from about 20 to about 70 percent. In one embodiment, the throat 70 is positioned at a specified distance from the flow-obstructing element 54. Specifically, in the exemplary embodiment as illustrated, the flow-obstructing element 54 includes a generally rounded shape and has a diameter D. Alternatively, in another embodiment as shown in FIG. 4, a flow-obstructing element 154 is generally rectangular in shape and includes a width W. Continuing to refer to FIG. 4, the width W or the diameter D (shown in FIG. 2) is measured in relation to a diameter 180 of the flow sleeve 142. Referring back to FIG. 2, the throat 70 of the venturi 60 is positioned at a specific distance which is annotated by N*D, where D is the diameter D of the flow-obstructing element 54, and N is a number ranging from about 1 to about 10. That is, the specified distance N*D ranges from about the diameter D of the flow-obstructing element 54 to about ten times the diameter D of the flow-obstructing element 54. In an alternative embodiment, if a generally rectangular flow-obstructing element is employed (such as the flow-obstructing element 154 that is illustrated in FIG. 4), then the specific distance may be calculated by N*W, where W is the width of the flow-obstructing element 54. It is to be understood that while FIGS. 2 and 4 illustrate generally rounded or rectangular profiles, the flow-obstructing element 54 may include any type of shape or configuration.

Continuing to refer to FIG. 2, in one embodiment at least one air aperture 72 may also be provided in the venturi portion 60 of the flow sleeve 42 to fluidly connected to the air passage 46 to the air passage 44. Specifically, the air aperture 72 is located within the flow sleeve 42 at the diverging section 68 of the venture portion 60. It should be noted that while FIG. 2 illustrates the air aperture 72 located at the diverging section 68, it is to be understood that other locations may be used as well. For example, the air aperture 72 may be located in the converging section 66 as well. In another embodiment, the air aperture 72 may be located in the flow sleeve 42 upstream of the venturi 60, and downstream of the flow-obstructing element 54. The air aperture 72 may be used to introduce relatively higher pressure air into the air passage 44. Specifically, referring to both of FIGS. 1-2, the air aperture 72 receives a portion of the compressor discharge air 32 from the second air passage 46. The airflow in the second air passage 46 has a higher pressure than the airflow located in the air passage 44. Thus, the air aperture 72 locally introduces a relatively higher pressure air into the airflow of the air passage 44. The air aperture 72 may be included in an effort to increase the air pressure in the air passage 44, because the air pressure across the venturi 60 decreases as the velocity of the airflow increases. The air aperture 72 adds air to the wake, which therefore increases the velocity of the air located within the wake. It should be noted that while the presence of the air aperture 72 is illustrated, it is to be understood that the air aperture 72 may be omitted in another embodiment as well.

Figure 3:
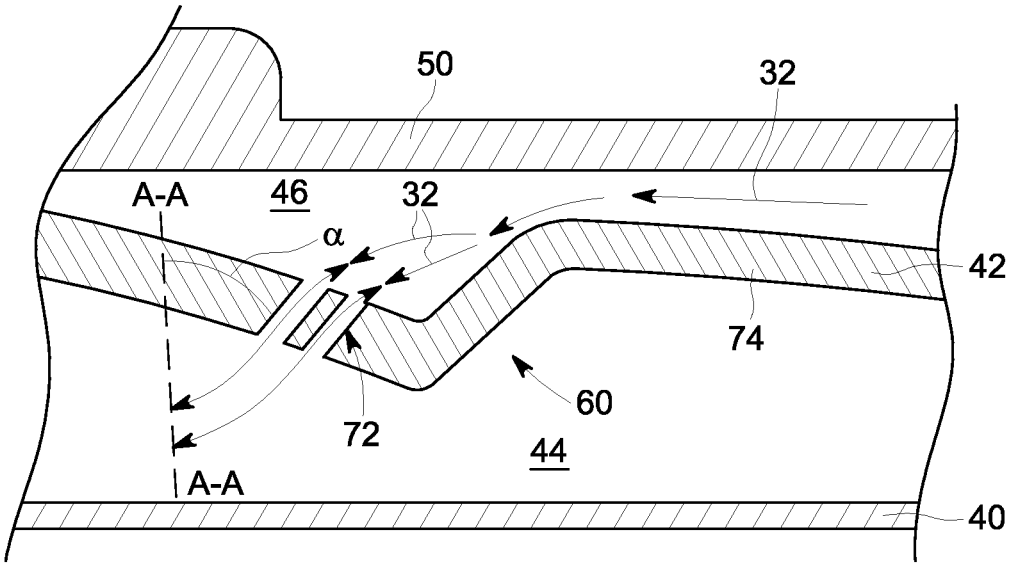
FIG. 3 is a cross-sectional view of an alternate airflow passage similar to that shown in FIG. 2.

In the embodiment as shown in FIG. 2, the air aperture 72 is located within the wall 74 of the flow sleeve 42. FIG. 3 is a cross-sectional view of multiple air apertures 72 located within the flow sleeve 42. As shown in FIG. 3, the air apertures 72 are typically thru-holes located within the diverging section 68 of the flow sleeve 42. The air apertures 72 may also be angled in relation to a vertical axis A-A, as shown by angle $\alpha$. In one embodiment, the angle $\alpha$ ranges between about 5 degrees to about 80 degrees. The compressor discharge air 32 flows through the air apertures 72 and into the air passage 44.

Figure 5:
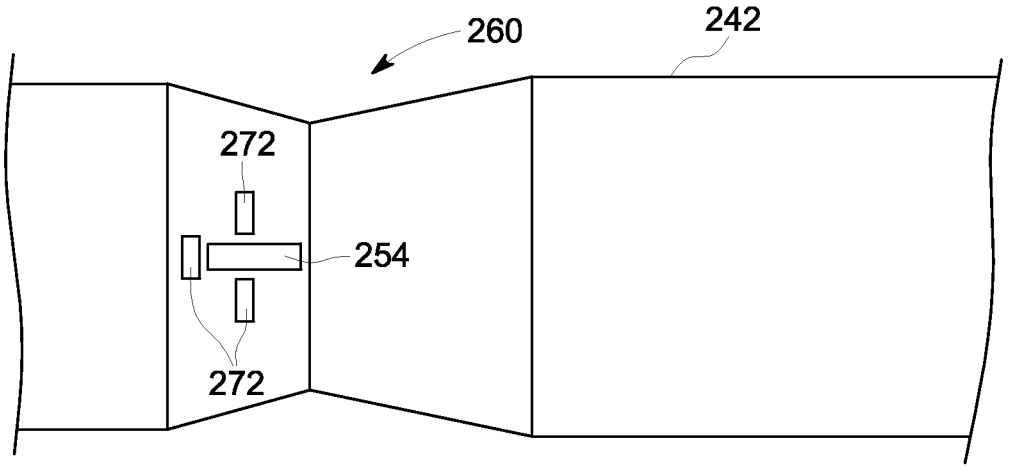
FIG. 5 is a schematic overhead view of another embodiment of the air aperture shown in FIG. 2.

Although FIG. 2 illustrates the air aperture 72 having a generally circular configuration, it is to be understood that the air aperture 72 may include other configurations as well. For example, in another embodiment, the air apertures 72 may include a slotted or a teardrop configuration as well. FIGS. 4-5 are schematic illustrations that show several different arrangements of the air apertures 172 and 272. Specifically, in the embodiment as shown in FIG. 4, the air apertures 172 are arranged in a staggered configuration circumferentially along a diverging section 168. Similar to the embodiment as shown in FIG. 2, each of the air apertures 172 are positioned downstream of a flow-obstructing element 154. In an alternative embodiment shown in FIG. 5, the air apertures 272 include a generally rectangular profile. Some of the air apertures 272 are located adjacent to and generally surrounding a flow liner stop 254. A remaining portion of the air apertures 272 are positioned downstream of the flow liner stop 254. It should be noted that a portion of the air apertures 272 may also be positioned upstream of the flow liner stop 254 as well (not shown in FIG. 5).

Referring now to FIGS. 1-5, including the venturi 60 results in a relatively wake-free airflow in the air passage 44 that is delivered to the quaternary cap 22 and the quaternary vanes 62. Reduction in wakes within the air passage 44 tends to reduce or substantially prevent the occurrence of flame holding. A generally wake-free airflow in the air passage 44 may also improve features, such as gas turbine flame holding performance. Because the air pressure across the venturi 60 decreases as the velocity of the airflow increases, in one embodiment, the air aperture 72 is also included in an effort to increase the air pressure in the air passage 44.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustion system, comprising:

a combustor liner disposed around a combustion region;

a combustor flow sleeve disposed around the combustor liner, the combustor liner and the combustor flow sleeve cooperating to create an air passage configured to receive an airflow, the air passage being located between the combustor liner and the combustor flow sleeve;

a flow-obstructing element disposed within the air passage, the flow-obstructing element generally obstructing the airflow in the air passage and creating wakes in the airflow, wherein the flow-obstructing element is one of a cross-fire tube, a flame detector, a spark plug, a liner stop, a boss, a pressure probe, or a sensor; and a venturi section disposed downstream from the flow-obstructing element, the venturi section comprising:

a first wall defined by one of the combustor liner or the combustor flow sleeve and a second wall defined by the other of the combustor liner or the combustor flow sleeve, wherein one of the first wall or the second wall converges toward the other of the first wall or the second wall defining a converging area and diverges downstream of the converging area from the other of the first wall or the second wall defining a diverging area, the diverging area being greater than the converging area, wherein a throat connects the converging area and the diverging area, the throat placed at a distance from the flow-obstructing element, the distance being no less than one and no greater than ten times a width or a diameter of the flow-obstructing element, wherein at least one air aperture is defined within the combustor flow sleeve in the diverging area downstream of the throat, and wherein the venturi section generally restricts and diffuses the airflow in the air passage to generally reduce wakes in the airflow.

2. The combustion system of claim 1, wherein the first wall is defined by the combustor flow sleeve.

3. The combustion system of claim 1, wherein the throat provides a reduction in a cross-sectional area of the air passage ranging from about 20 to about 70 percent.

4. The combustion system of claim 1, wherein the at least one air aperture is fluidly connected to the air passage, and wherein the at least one air aperture receives a high pressure air that is injected into the air passage, the high pressure air having a pressure that is greater than an air passage pressure of the air passage.

5. The combustion system of claim 4, wherein the at least one air aperture is a thru-hole located within the combustor flow sleeve, and wherein the at least one air aperture is positioned at an angle in relation to a vertical axis.

6. The combustion system of claim 5, wherein the angle ranges between about 5 degrees to about 80 degrees.

7. The combustion system of claim 4, comprising a plurality of air apertures, wherein a portion of the plurality of air apertures are positioned adjacent to and generally surrounding the flow-obstructing element, and another portion of the plurality of air apertures are positioned downstream of the flow-obstructing element, and a remaining portion of the plurality of air apertures are positioned upstream of the flow-obstructing element.

8. The combustion system of claim 1, wherein the airflow is directed to a set of quaternary vanes located in the combustion system.

9. A gas turbine having combustion system, comprising:

a combustor liner disposed around a combustion region;

a combustor flow sleeve disposed around the combustor liner, the combustor liner and the combustor flow sleeve cooperating to create an air passage configured to receive an airflow, the air passage being located between the combustor liner and the combustor flow sleeve; a flow-obstructing element disposed within the air passage, the flow-obstructing element generally obstructing the airflow in the air passage and creating wakes in the airflow, wherein the flow-obstructing element is one of a cross-fire tube, a flame detector, a spark plug, a liner stop, a boss, a pressure probe, or a sensor; and a venturi section disposed downstream from the flow-obstructing element, the venturi section comprising:

a first wall defined by one of the combustor liner or the combustor flow sleeve, a second wall defined by the other of the combustor liner or the combustor flow sleeve, wherein one of the first wall or the second wall converges toward the other of the first wall or the second wall defining a converging area and diverges downstream of the converging area from the other of the first wall or the second wall defining a diverging area, the diverging area being greater than the converging area, and at least one air aperture that is fluidly connected to the air passage, the at least one air aperture defined within the diverging area of the combustor flow sleeve, the at least one air aperture receiving a high pressure air that is injected into the air passage, the high pressure air having a pressure that is greater than an air passage pressure of the air passage.

10. The gas turbine of claim 9, wherein the first wall is defined by the combustor flow sleeve.

11. The gas turbine of claim 9, wherein the venturi section includes a throat, wherein the throat connects the converging area with the diverging area, and wherein the throat provides a reduction in a cross-sectional area of the air passage ranging from about 20 to about 70 percent.

12. The gas turbine of claim 11, wherein the flow-obstructing element includes a dimension that represents one of a width and a diameter of the flow-obstructing element.

13. The gas turbine of claim 12, wherein the throat is located at a specified distance from the flow-obstructing element, wherein the specified distance ranges from about the dimension of the flow-obstructing element to about ten times the dimension of the flow-obstructing element.

14. The gas turbine of claim 9, wherein the at least one air aperture is a thru-hole located within the combustor flow sleeve, and wherein the at least one air aperture is positioned at an angle in relation to a vertical axis.

15. The gas turbine of claim 14, wherein the angle ranges between about 5 degrees to about 80 degrees.

* * * * *